US011257414B2

(12) United States Patent
Saeki et al.

(10) Patent No.: US 11,257,414 B2
(45) Date of Patent: Feb. 22, 2022

(54) METHOD AND SYSTEM FOR STABILIZING A SOURCE OUTPUT VOLTAGE FOR A DISPLAY PANEL

(71) Applicant: SYNAPTICS INCORPORATED, San Jose, CA (US)

(72) Inventors: Yutaka Saeki, Tokyo (JP); Taisuke Koshino, Tokyo (JP); Yoshinori Ura, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 215 days.

(21) Appl. No.: 16/454,355

(22) Filed: Jun. 27, 2019

(65) Prior Publication Data

US 2020/0410919 A1 Dec. 31, 2020

(51) Int. Cl.

| | |
|---|---|
| ***G09G 3/20*** | (2006.01) |
| ***G09G 3/36*** | (2006.01) |
| ***G09G 3/3275*** | (2016.01) |

(52) U.S. Cl.

CPC ..... *G09G 3/2007* (2013.01); *G09G 3/3275* (2013.01); *G09G 3/3607* (2013.01); *G09G 3/3688* (2013.01); *G09G 2310/027* (2013.01); *G09G 2320/0252* (2013.01)

(58) Field of Classification Search

CPC .. G09G 3/2007; G09G 3/3225; G09G 3/3275; G09G 3/3291; G09G 3/3607; G09G 3/3611; G09G 3/3648; G09G 3/3685; G09G 3/3688; G09G 3/3696; G09G 2310/0243; G09G 2310/0264; G09G 2310/027; G09G 2310/0289; G09G 2310/0291; G09G 2320/0252; G09G 2320/0276; H03M 1/06; H03M 1/0612

See application file for complete search history.

(56) References Cited

U.S. PATENT DOCUMENTS

| | | | | |
|---|---|---|---|---|
| 2006/0049868 | A1* | 3/2006 | Yeh | H03F 1/34 327/538 |
| 2007/0132699 | A1* | 6/2007 | Kim | G09G 3/3685 345/100 |
| 2008/0111628 | A1* | 5/2008 | Tsuchi | G09G 3/3688 330/282 |
| 2008/0204439 | A1* | 8/2008 | Morita | G09G 3/3688 345/209 |
| 2009/0167747 | A1* | 7/2009 | Gong | H03F 3/4521 345/212 |
| 2011/0157129 | A1* | 6/2011 | Song | G09G 3/3685 345/211 |
| 2015/0356932 | A1* | 12/2015 | Kim | G09G 3/3688 345/690 |

(Continued)

*Primary Examiner* — Keith L Crawley

(74) *Attorney, Agent, or Firm* — Ferguson Braswell Fraser Kubasta PC

(57) ABSTRACT

A display driver comprises: a first grayscale line; output circuitry configured to receive a first grayscale voltage from the first grayscale line and perform digital-analog conversion on a pixel data to output a source output voltage corresponding to the pixel data, the digital-analog conversion being based on the first grayscale voltage; and first gamma assist circuitry comprising a first holding node to hold the first grayscale voltage received from the first grayscale line and configured to drive the first grayscale line based on a first voltage between the first holding node and the first grayscale line.

20 Claims, 9 Drawing Sheets

(56) References Cited

U.S. PATENT DOCUMENTS

| | | | | |
|---|---|---|---|---|
| 2016/0133218 | A1* | 5/2016 | Morita | G09G 3/3696<br>345/213 |
| 2017/0032759 | A1* | 2/2017 | Hwang | G09G 3/3688 |
| 2018/0151593 | A1* | 5/2018 | Inoue | G09G 3/3648 |
| 2020/0380904 | A1* | 12/2020 | Yeh | G09G 3/20 |

* cited by examiner

METHOD AND SYSTEM FOR STABILIZING A SOURCE OUTPUT VOLTAGE FOR A DISPLAY PANEL

BACKGROUND

Field

This disclosure relates to a device and method for driving a display panel.

Description of the Related Art

A display driver driving a display panel such as a liquid crystal display panel and an organic light emitting diode (OLED) display panel may be configured to output a source output voltage to a source line, which may be also referred to as a signal line or data line. To achieve image display with a high refresh rate, a display driver may be designed to reduce a setting time of a source output voltage.

SUMMARY

In one or more embodiments, a display driver comprises: a first grayscale line; output circuitry configured to receive a first grayscale voltage from the first grayscale line and perform digital-analog conversion on a pixel data to output a source output voltage corresponding to the pixel data, the digital-analog conversion being based on the first grayscale voltage; and first gamma assist circuitry comprising a first holding node to hold thereon the first grayscale voltage received from the first grayscale line and configured to drive the first grayscale line based on a first voltage between the first holding node and the first grayscale line.

In one or more embodiments, a method comprises: receiving a grayscale voltage from a first grayscale line; performing digital-analog conversion on a pixel data to output a source output voltage corresponding to the pixel data, the digital-analog conversion being based on the grayscale voltage; holding the first grayscale voltage received from the first grayscale line on a holding node; and driving the first grayscale line based on a first voltage between the holding node and the first grayscale line.

DETAILED DESCRIPTION

Figure 1:
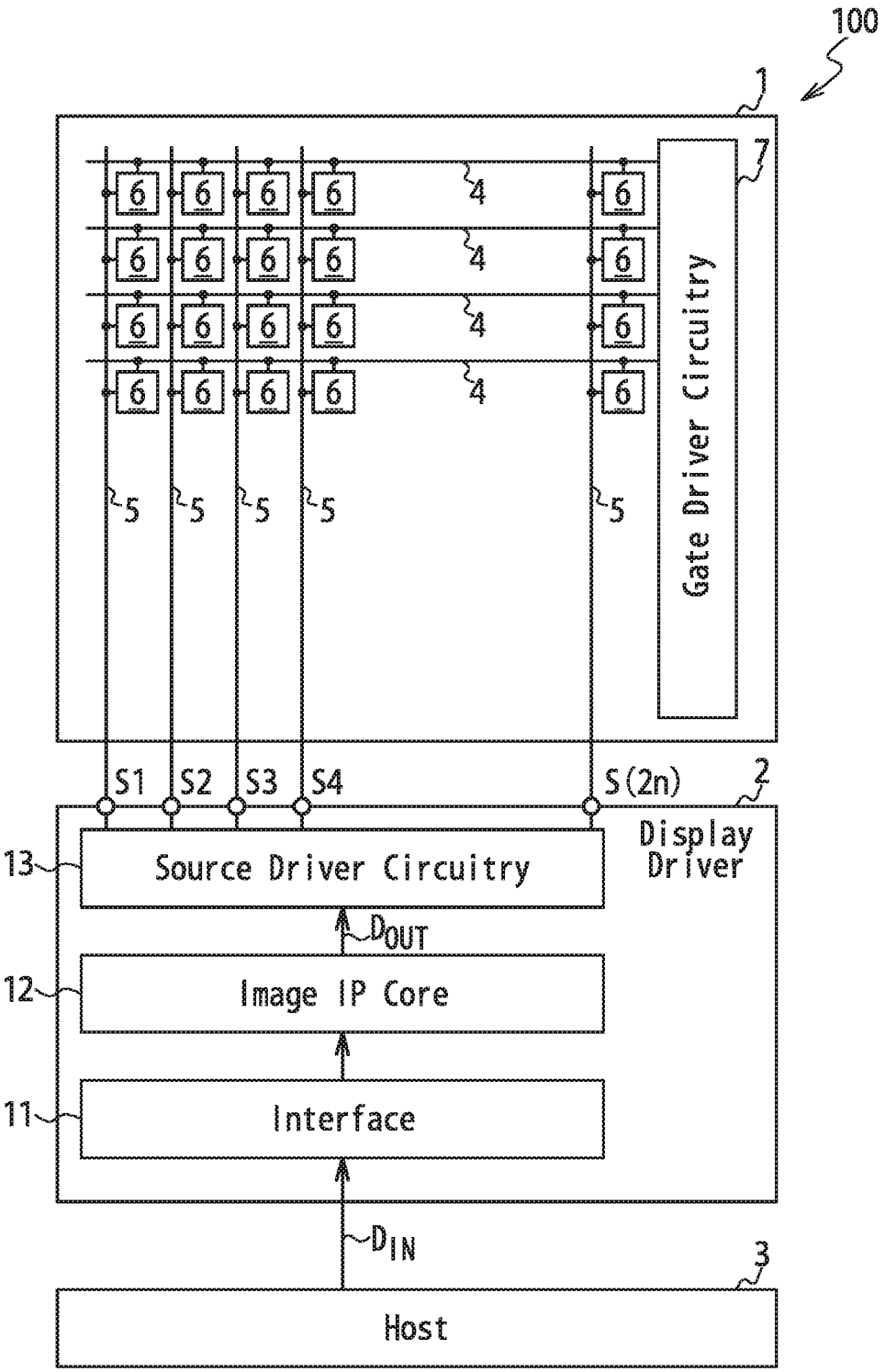
FIG. 1 illustrates one example configuration of a display device, according to one or more embodiments.

In the following, a description is given of embodiments of the present disclosure with reference to the attached drawings. In the attached drawings, same or similar components may be denoted by same or corresponding reference numerals. Suffixes may be attached to reference numerals to distinguish same components from each other.

In one or more embodiments, as illustrated in FIG. 1, a display device 100 comprises a display panel 1 and a display driver 2. In one or more embodiments, the display device 100 is configured to display an image on the display panel 1 based on an image data $D_{IN}$ received from a host 3.

In one or more embodiments, the display panel 1 comprises gate lines 4, which may be also referred to as scan lines, source lines 5, display elements 6, and gate driver circuitry 7 configured to drive the gate lines 4. In one or more embodiments, each display element 6 is disposed at an intersection of a corresponding gate line 4 and source line 5. When an OLED display panel is used as the display panel 1, the display elements 6 may each comprise a light emitting element, a select transistor, and a hold capacitor in one or more embodiments. When a liquid crystal display panel is used as the display panel 1, the display elements 6 may each comprise a pixel electrode, a select transistor, and a hold capacitor, in one or more embodiments. Various interconnections other than the gate lines 4 and the source lines 5 may be disposed in the display panel 1, depending on the configuration of the display elements 6.

In one or more embodiments, the display driver 2 comprises source outputs S1 to S(2*n*) respectively connected to the source lines 5 of the display panel 1 and drives the source lines 5 based on the image data $D_{IN}$ received from the host 3. In one or more embodiments, the display driver 2 comprises an interface 11, an image IP core 12, and source driver circuitry 13. In one or more embodiments, the interface 11 receives the image data $D_{IN}$ from the host 3 and forwards the same to the image IP core 12. In one or more embodiments, the image IP core 12 performs desired image processing on the image data $D_{IN}$ to generate a processed image data $D_{OUT}$. In one or more embodiments, the source driver circuitry 13 drives the source lines 5 of the display panel 1 to source output voltages corresponding to the processed image data $D_{OUT}$ received from the image IP core 12. In one or more embodiments, the processed image data $D_{OUT}$ comprises pixel data describing grayscale values of the respective display elements 6 of the display panel 1.

In one or more embodiments, in each horizontal sync period, source output voltages corresponding to the grayscale values described in the pixel data are written into display elements 6 connected to the gate line 4 selected in the horizontal sync period, via the source lines 5. In one or more embodiments, the brightness level of each display element 6 corresponds to the source output voltage written into the display element 6.

Figure 2:
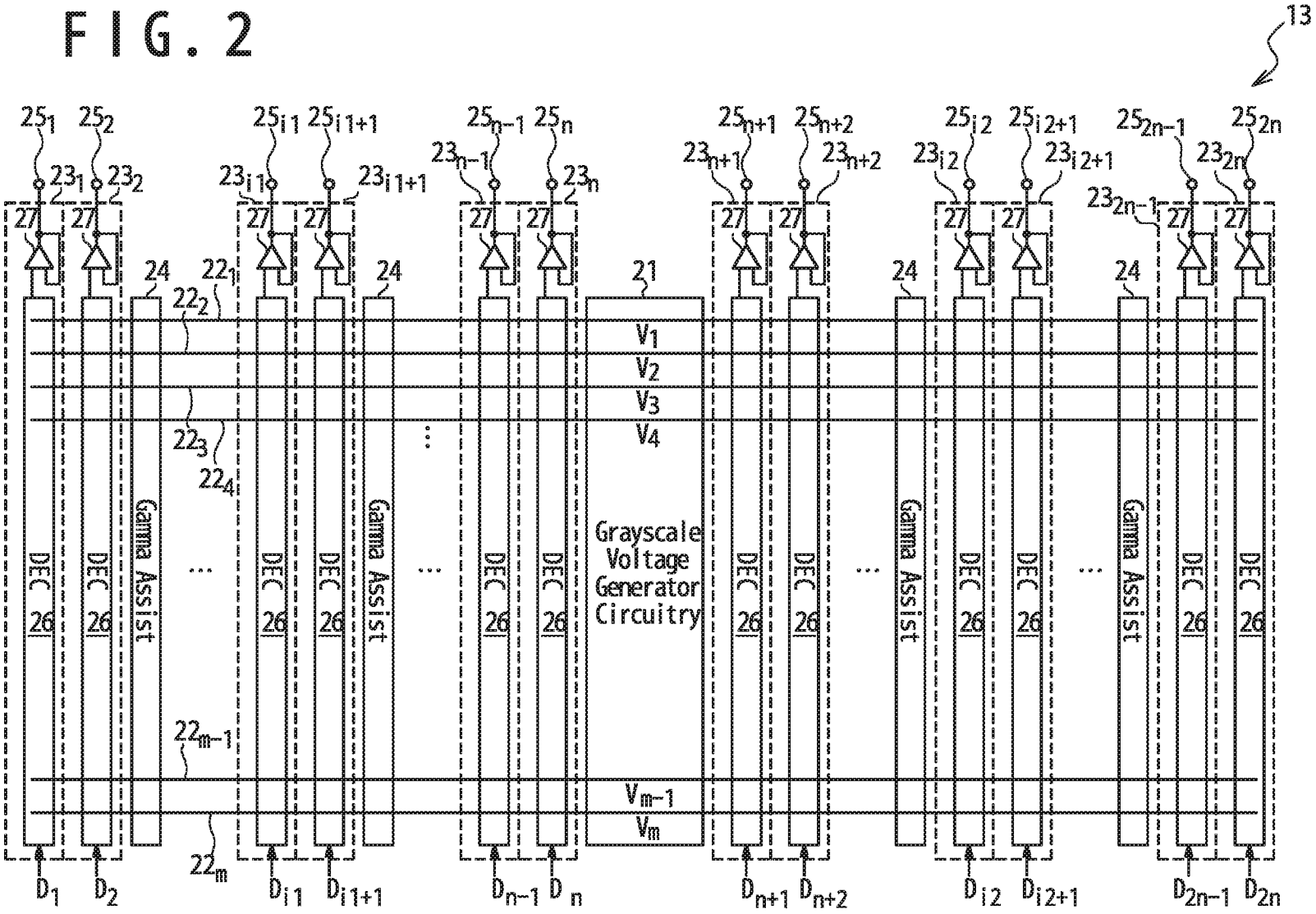
FIG. 2 illustrates one example configuration of source driver circuitry, according to one or more embodiments.

In one or more embodiments, as illustrated in FIG. 2, the source driver circuitry 13 comprises grayscale voltage generator circuitry 21, a plurality of grayscale lines $\mathbf{22}_1$ to $\mathbf{22}_m$, a plurality of output circuitries $\mathbf{23}_1$ to $\mathbf{23}_{2n}$, and a plurality of gamma assist circuitries 24. In FIG. 2, the symbols $D_1$ to $D_{2n}$ denote pixel data of the processed image data $D_{OUT}$ supplied to the source driver circuitry 13, the pixel data being associated with the source outputs S1 to S(2*n*), respectively.

In one or more embodiments, the grayscale voltage generator circuitry 21 is configured to generate grayscale voltages $V_1$ to $V_m$ respectively corresponding to allowed grayscale values of the pixel data $D_1$ to $D_{2n}$ and supply the generated grayscale voltages $V_1$ to $V_m$ to the output circuitries $\mathbf{23}_1$ to $\mathbf{23}_{2n}$ via the grayscale lines $\mathbf{22}_1$ to $\mathbf{22}_m$, respectively. In one or more embodiments, the voltage levels of the grayscale voltages $V_1$ to $V_m$ are different from one another.

In one or more embodiments, the grayscale voltage generator circuitry 21 is configured to maintain the grayscale voltages $V_1$ to $V_m$ at desired voltage levels. In one or more embodiments, the grayscale voltage generator circuitry 21 is configured to, when the grayscale voltages $V_1$ to $V_m$ undesirably change from the desired voltage levels, bring the grayscale voltages $V_1$ to $V_m$ back to the desired voltage levels.

In one or more embodiments, the output circuitries $\mathbf{23}_1$ to $\mathbf{23}_{2n}$ are configured to perform digital-analog conversion on the pixel data $D_1$ to $D_{2n}$ to output source output voltages corresponding to the pixel data $D_1$ to $D_{2n}$ to output terminals $\mathbf{25}_1$ to $\mathbf{25}_{2n}$, the digital-analog conversion being based on the grayscale voltages $V_1$ to $V_m$ received via the grayscale lines $\mathbf{22}_1$ to $\mathbf{22}_m$. In one or more embodiments, the output terminals $\mathbf{25}_1$ to $\mathbf{25}_{2n}$ are connected to the source outputs S1 to S(2*n*), and the source output voltages outputted from the output circuitries $\mathbf{23}_1$ to $\mathbf{23}_{2n}$ are supplied to desired display elements 6 via the source outputs S1 to S(2*n*) and the source lines 5.

In one or more embodiments, each output circuitry $\mathbf{23}_i$ comprises a decoder 26 and a source amplifier 27. In one or more embodiments, the decoder 26 of the output circuitry $\mathbf{23}_i$ outputs to the source amplifier 27 at least one grayscale voltage selected from the grayscale voltages $V_1$ to $V_m$ based on the pixel data $D_i$. In one or more embodiments, the source amplifier 27 of the output circuitry $\mathbf{23}_i$ generates a source output voltage corresponding to the grayscale voltage selected by the decoder 26 on the output terminal $\mathbf{25}_i$. In one or more embodiments, the source amplifier 27 comprises a plurality of inputs and is configured to feed back the source output voltage to a first input and receive the grayscale voltage selected by the decoder 26 on a second input. In one or more embodiments, the source amplifier 27 is configured as a voltage follower.

In one or more embodiments, the grayscale voltages $V_1$ to $V_m$ generated on the grayscale lines $\mathbf{22}_1$ to $\mathbf{22}_m$ may vary upon changes in the source output voltages outputted from the output circuitries $\mathbf{23}_1$ to $\mathbf{23}_{2n}$. In one or more embodiments, when the source output voltages outputted from the source amplifiers 27 vary, the voltages on the second inputs of the source amplifiers 27, which receive the grayscale voltages from the decoders 26, may vary due to an influence of the input load capacitances. This may cause changes in the voltage levels of the grayscale voltages $V_1$ to $V_m$ on the grayscale lines $\mathbf{22}_1$ to $\mathbf{22}_m$.

In one or more embodiments, the grayscale voltage generator circuitry 21 operates to bring the grayscale voltages $V_1$ to $V_m$ back to the desired levels when the grayscale voltages $V_1$ to $V_m$ on the grayscale lines $\mathbf{22}_1$ to $\mathbf{22}_m$ undesirably change. This operation makes it possible to rapidly bring the grayscale voltage $V_1$ to $V_m$ back to the desired voltage levels at least in the vicinity of the grayscale voltage generator circuitry 21.

In one or more embodiments, the gamma assist circuitries 24 are configured to drive the grayscale lines $\mathbf{22}_1$ to $\mathbf{22}_m$ at positions apart from the grayscale voltage generator circuitry 21 to assist the bringing back of the grayscale voltages $V_1$ to $V_m$ to the desired voltage levels. Such operation of the gamma assist circuitries 24 may be hereinafter referred to as "gamma assist operation." Performing the gamma assist operation is effective for rapidly bringing the grayscale voltages $V_1$ to $V_m$ back to the desired voltage levels over the entire of the grayscale lines $\mathbf{22}_1$ to $\mathbf{22}_m$. In one or more embodiments, the gamma assist operation reduces settling times of the source output voltages and thereby allows image display at a high refresh rate.

Figure 3:
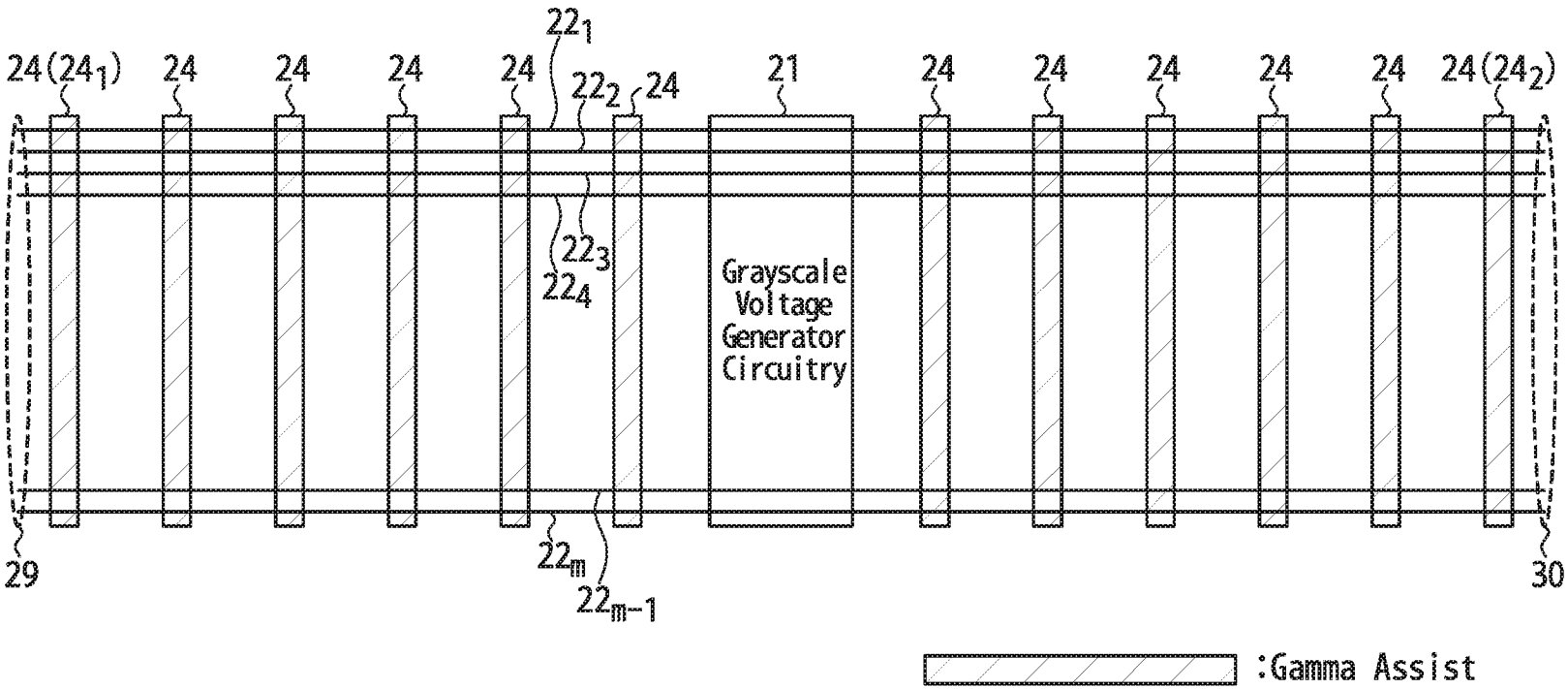
FIG. 3 illustrates one example arrangement of gamma assist circuitry, according to one or more embodiments.

In one or more embodiments, as illustrated in FIG. 3, the plurality of gamma assist circuitries 24 are distributedly arranged along the direction in which the grayscale lines $\mathbf{22}_1$ to $\mathbf{22}_m$ are extended. In one or more embodiments, first gamma assist circuitry $\mathbf{24}_1$ of the plurality of gamma assist circuitries 24 is disposed at first ends 29 of the grayscale lines $\mathbf{22}_1$ to $\mathbf{22}_m$, and second gamma assist circuitry $\mathbf{24}_2$ is disposed at second ends 30 of the grayscale lines $\mathbf{22}_1$ to $\mathbf{22}_m$. In one or more embodiments, the grayscale voltage generator circuitry 21 is disposed at midpoints of the grayscale lines $\mathbf{22}_1$ to $\mathbf{22}_m$. In one or more embodiments, half the remaining gamma assist circuitries 24 are disposed between the first gamma assist circuitry $\mathbf{24}_1$ and the grayscale voltage generator circuitry 21 at constant intervals and the remaining half are disposed between the second gamma assist circuitry $\mathbf{24}_2$ and the grayscale voltage generator circuitry 21 at constant intervals.

Figure 4:
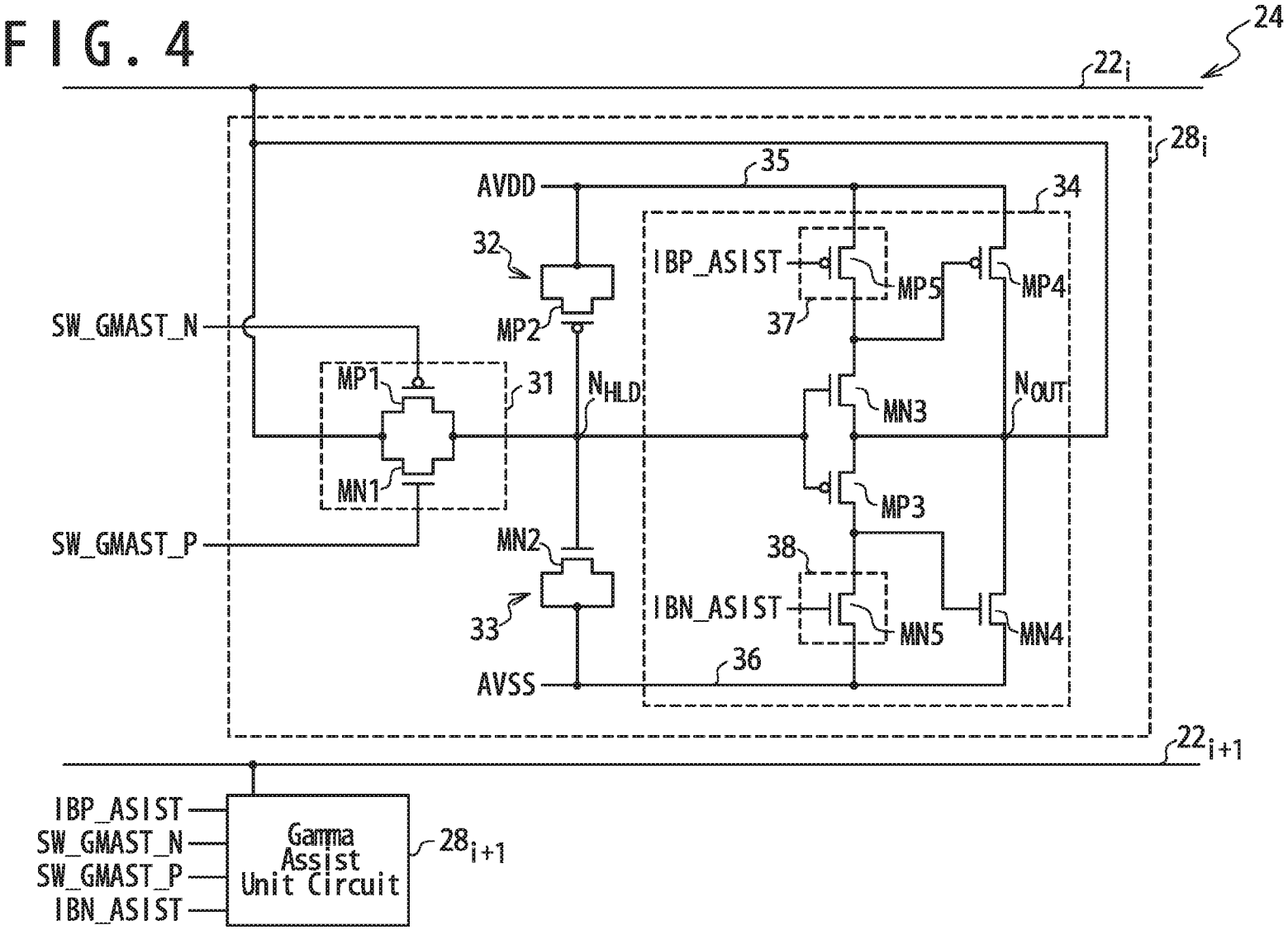
FIG. 4 illustrates one example configuration of gamma assist circuitry, according to one or more embodiments.

In one or more embodiments, as illustrated in FIG. 4, each gamma assist circuitry 24 comprises a plurality of gamma assist unit circuits 28 respectively connected to the grayscale lines $\mathbf{22}_1$ to $\mathbf{22}_m$. In FIG. 4, the gamma assist unit circuit 28 connected to the grayscale line $\mathbf{22}_i$ is denoted by the numeral $\mathbf{28}_i$, and the gamma assist unit circuit 28 connected to the grayscale line $\mathbf{22}_{i+1}$ is denoted by the numeral $\mathbf{28}_{i+1}$.

In one or more embodiments, the gamma assist unit circuit $\mathbf{28}_i$ comprises a holding node $N_{HLD}$ to hold the grayscale voltage $V_i$ received from the grayscale line $\mathbf{22}_i$ and is configured to drive the grayscale line $\mathbf{22}_i$ based on a voltage between the holding node $N_{HLD}$ and the grayscale line $\mathbf{22}_i$.

In one or more embodiments, the gamma assist unit circuit $\mathbf{28}_i$ comprises a gamma assist switch 31, capacitor elements 32, 33, and source follower circuitry 34.

In one or more embodiments, the gamma assist switch 31 is connected between the grayscale line $\mathbf{22}_i$ and the holding node $N_{HLD}$. In one or more embodiments, the gamma assist switch 31 is configured to electrically connect and disconnect the grayscale line $\mathbf{22}_i$ and the holding node $N_{HLD}$, based on the switch control signals SW_GMAST_P and SW_GMAST_N.

In one or more embodiments, the gamma assist switch 31 is configured as a transmission gate comprising a PMOS transistor MP1 and an NMOS transistor MN1. In one or more embodiments, the switch control signal SW_GMAST_N is supplied to the gate of the PMOS transistor MP1, and the switch control signal SW_GMAST_P is supplied to the gate of the NMOS transistor MN1. In one or more embodiments, the switch control signals SW_GMAST_P and SW_GMAST_N are complementary to each other. In one or more embodiments, the switch control signal SW_GMAST_P is a high active signal, which is pulled up to the high level when asserted. In such embodiments, the switch control signal SW_GMAST_N is a low active signal, which is pulled down to the low level when asserted. In one or more embodiments, the gamma assist switch 31 is turned on when the switch control signals SW_GMAST_P and SW_GMAST_N are asserted, and turned off when negated.

In one or more embodiments, the capacitor element 32 is connected between a power supply line 35 and the holding node $N_{HLD}$, and the capacitor element 33 is connected between a grounding line 36 and the holding node $N_{HLD}$. In one or more embodiments, the power supply line 35 and the ground line 36 are both potential-fixed lines of fixed potentials. In one or more embodiments, the power supply line 35 has an analog power supply level AVDD, and the grounding line 36 is circuit-grounded. In FIG. 4, the potential of the circuit ground is denoted by the symbol "AVSS." In one or more embodiments, the capacitor elements 32 and 33 are used to stably hold the grayscale voltage $V_i$ which has been written from the grayscale line $\mathbf{22}_i$ via the gamma assist switch 31 on the holding node $N_{HLD}$ when the gamma assist switch 31 is turned off. In one or more embodiments, a gate capacitance of a PMOS transistor MP2 is used as the capacitor element 32, and a gate capacitance of an NMOS transistor MN2 is used as the capacitor element 33. In one or more embodiments, the PMOS transistor MP2 has a source and drain connected to the power supply line 35 and a gate connected to the holding node $N_{HLD}$. In one or more embodiments, the NMOS transistor MN2 has a source and drain connected to the grounding line 36 and a gate connected to the holding node $N_{HLD}$.

In one or more embodiments, the source follower circuitry 34 of the gamma assist unit circuit $\mathbf{28}_i$ comprises an output node $N_{OUT}$ connected to the grayscale line $\mathbf{22}_i$ and is configured to drive the grayscale line $\mathbf{22}_i$ through a source follower operation, based on the voltage between the holding node $N_{HLD}$ and the grayscale line $\mathbf{22}_i$. In one or more embodiments, the source follower circuitry 34 comprises NMOS transistors MN3, MN4, PMOS transistors MP3, MP4, and constant current sources 37 and 38.

In one or more embodiments, the NMOS transistor MN3 has a gate connected to the holding node $N_{HLD}$, a source connected to the output node $N_{OUT}$, and a drain supplied with a constant current from the constant current source 37. In one or more embodiments, this connection generates a potential corresponding to the voltage between the holding node $N_{HLD}$ and the output node $N_{OUT}$ on the drain of the NMOS transistor MN3. In one or more embodiments, the constant current source 37 comprises a PMOS transistor MP5 having a gate supplied with a bias voltage IBP_ASIST, a source connected to the power supply line 35, and a drain connected to the drain of the NMOS transistor MN3.

In one or more embodiments, the PMOS transistor MP4 has a gate connected to the drain of the NMOS transistor MN3, a source connected to the power supply line 35, and a drain connected to the output node $N_{OUT}$. In one or more embodiments, the PMOS transistor MP4 operates as a pull-up transistor configured to pull up the output node $N_{OUT}$ based on the potential on the drain of the NMOS transistor MN3.

In one or more embodiments, the PMOS transistor MP3 has a gate connected to the holding node $N_{HLD}$, a source connected to the output node $N_{OUT}$, and a drain from which a constant current is drawn by the constant current source 38. In one or more embodiments, this connection generates a potential corresponding to the voltage between the holding node $N_{HLD}$ and the output node $N_{OUT}$ on the drain of the PMOS transistor MP3. In one or more embodiments, the constant current source 38 comprises an NMOS transistor MN5 having a gate supplied with a bias voltage IBN_ASIST, a source connected to the grounding line 36, and a drain connected to the drain of the PMOS transistor MP3.

In one or more embodiments, the NMOS transistor MN4 has a gate connected to the drain of the PMOS transistor MP3, a source connected to the grounding line 36, and a drain connected to the output node $N_{OUT}$. In one or more embodiments, the NMOS transistor MN4 operates as a pull-down transistor configured to pull down the output node $N_{OUT}$ based on the potential on the drain of the PMOS transistor MP3.

In one or more embodiments, the source follower circuitry 34 of the gamma assist unit circuit $\mathbf{28}_i$ is configured to reduce the voltage between the grayscale line $\mathbf{22}_i$ and the holding node $N_{HLD}$ by driving the grayscale line $\mathbf{22}_i$ with the PMOS transistor MP4 or the NMOS transistor MN4 when the voltage between the grayscale line $\mathbf{22}_i$ and the holding node $N_{HLD}$ is larger than a predetermined voltage. This operation makes it possible to bring the grayscale voltage $V_i$ back to the desired voltage level while suppressing excessive reaction to changes in the grayscale voltage $V_i$ generated on the grayscale line $\mathbf{22}_i$.

In one or more embodiments, the source follower circuitry 34 of the gamma assist unit circuit $\mathbf{28}_i$ is configured to raise the potential on the grayscale line $\mathbf{22}_i$ by activating the PMOS transistor MP4 when the potential on the grayscale line $\mathbf{22}_i$ is lower than the potential obtained by subtracting the threshold voltage of the NMOS transistor MN3 from the potential on the holding node $N_{HLD}$. In one or more embodiments, the source follower circuitry 34 of the gamma assist unit circuit $\mathbf{28}_i$ is configured to lower the potential on the grayscale line $\mathbf{22}_i$ by activating the NMOS transistor MN4 when the potential on the grayscale line $\mathbf{22}_i$ is higher than the potential obtained by adding the threshold voltage of the PMOS transistor MP3 to the potential on the holding node $N_{HLD}$.

Figure 5:
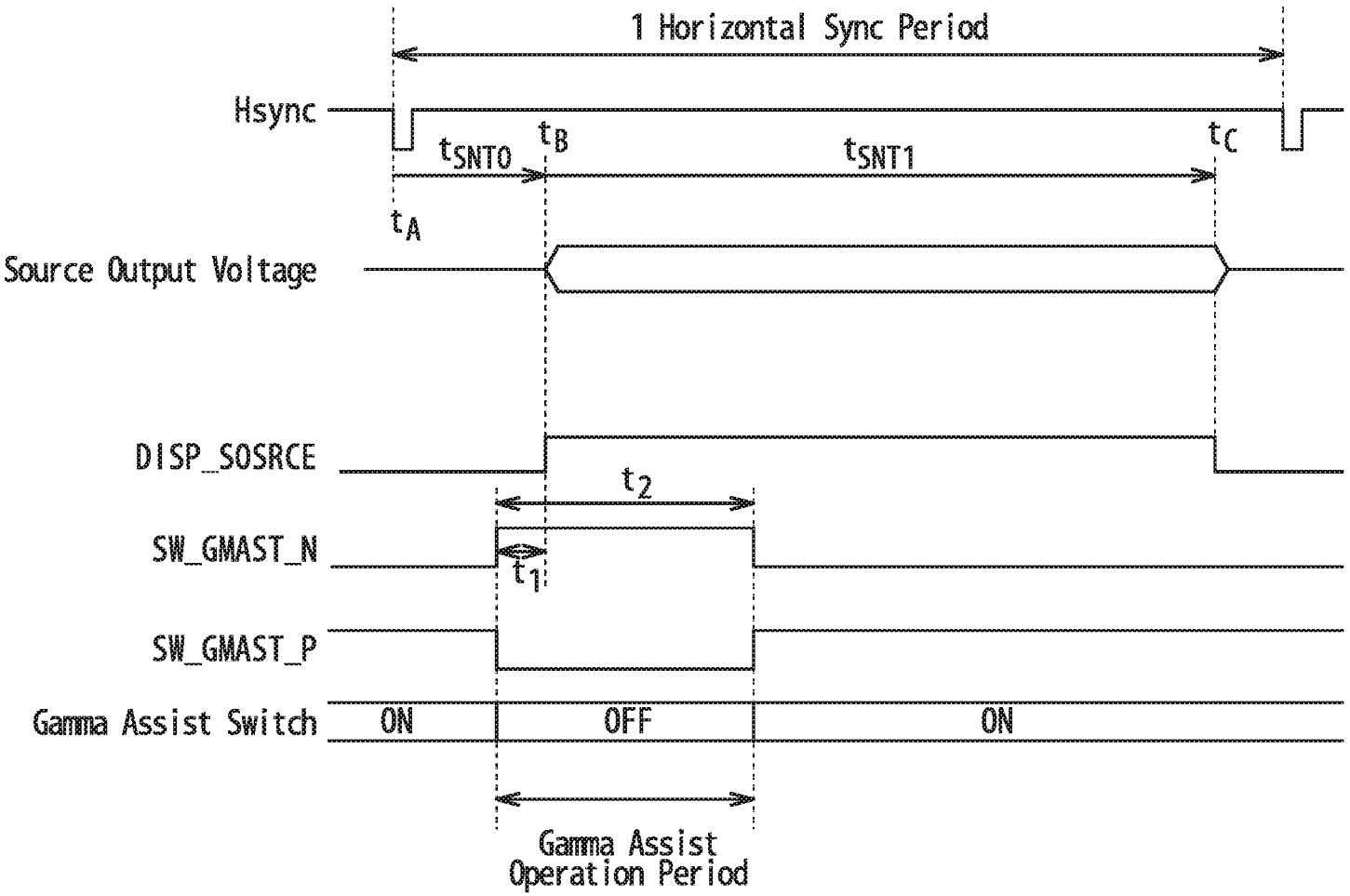
FIG. 5 illustrates one example operation of gamma assist circuitry, according to one or more embodiments.

With reference to FIG. 5, in one or more embodiments, each gamma assist unit circuit $\mathbf{28}_i$ is configured to perform the above-described "gamma assist operation" during a gamma assist operation period in each horizontal sync period, the gamma assist operation period being defined to include a time when the source output voltages start to change. In one or more embodiments, each gamma assist unit circuit $\mathbf{28}_i$ drives the grayscale line $\mathbf{22}_i$ based on the voltage between the holding node $N_{HLD}$ and the output node $N_{OUT}$ in the gamma assist operation. In one or more embodiments, each gamma assist unit circuit $\mathbf{28}_i$ writes the grayscale voltage $V_i$ generated on the grayscale line $\mathbf{22}_i$ into the holding node $N_{HLD}$ during a period other than the gamma assist operation period and drives the grayscale line $\mathbf{22}_i$ based on the voltage between the holding node $N_{HLD}$ and the output node $N_{OUT}$ during the gamma assist operation period. This operation allows rapidly bringing the grayscale voltage $V_i$ on the grayscale line $\mathbf{22}_i$ back to the original voltage after the grayscale voltage $V_i$ has changed due to changes in the source output voltages during the gamma assist operation period.

In one or more embodiments, a source amplifier control signal DISP_SOSRCE is asserted at time $t_B$ when a period of time $t_{SNT0}$ has elapsed after each horizontal sync period starts at time $t_A$. The source amplifiers 27 start to output the source output voltages based on the pixel data $D_1$ to $D_{2n}$ at time $t_B$. In this operation, the source output voltages start to change at time $t_B$. The switch control signals SW_GMAST_P and SW_GMAST_N are asserted to turn on the gamma assist switch 31 until the gamma assist operation period starts after each horizontal sync period has started. This allows writing the grayscale voltage $V_i$ on the grayscale line $\mathbf{22}_i$ into the holding node $N_{HLD}$ of the gamma assist unit circuit $\mathbf{28}_1$. In the state in which the gamma assist switch 31 is turned on, the holding node $N_{HLD}$ and the output node $N_{OUT}$ have the same potential, and the gamma assist operation is not performed.

In one or more embodiments, the gamma assist operation period starts a time duration $t_1$ in advance before the time $t_B$, which is the time when the source output voltages start to change. In one or more embodiments, the gamma assist switch 31 is turned off when the gamma assist operation period has started. In one or more embodiments, the gamma assist operation is performed to drive the grayscale line $\mathbf{22}_i$ based on the voltage between the holding node $N_{HLD}$ and the output node $N_{OUT}$, upon the turn-off of the gamma assist switch 31. In one or more embodiments, even when the grayscale voltage $V_i$ has changed due to changes in the source output voltages, the gamma assist operation brings the grayscale voltage $V_i$ generated on the grayscale line $\mathbf{22}_i$ back to the original voltage.

In one or more embodiments, the gamma assist operation period continues for a time duration $t_2$. In one or more embodiments, the time duration $t_2$ is set to be sufficiently long for completing the changes in the source output voltages in the gamma assist operation period. In one or more embodiments, the gamma assist switch 31 is turned on to stop the gamma assist operation when the gamma assist operation period has elapsed.

In one or more embodiments, the source amplifier control signal DISP_SOSRCE is negated at time $t_C$ when a period of time $t_{SNT1}$ has elapsed after time $t_B$, and the source amplifiers 27 stop outputting the source output voltages based on the pixel data $D_1$ to $D_{2n}$ at time $t_C$.

Figure 6:
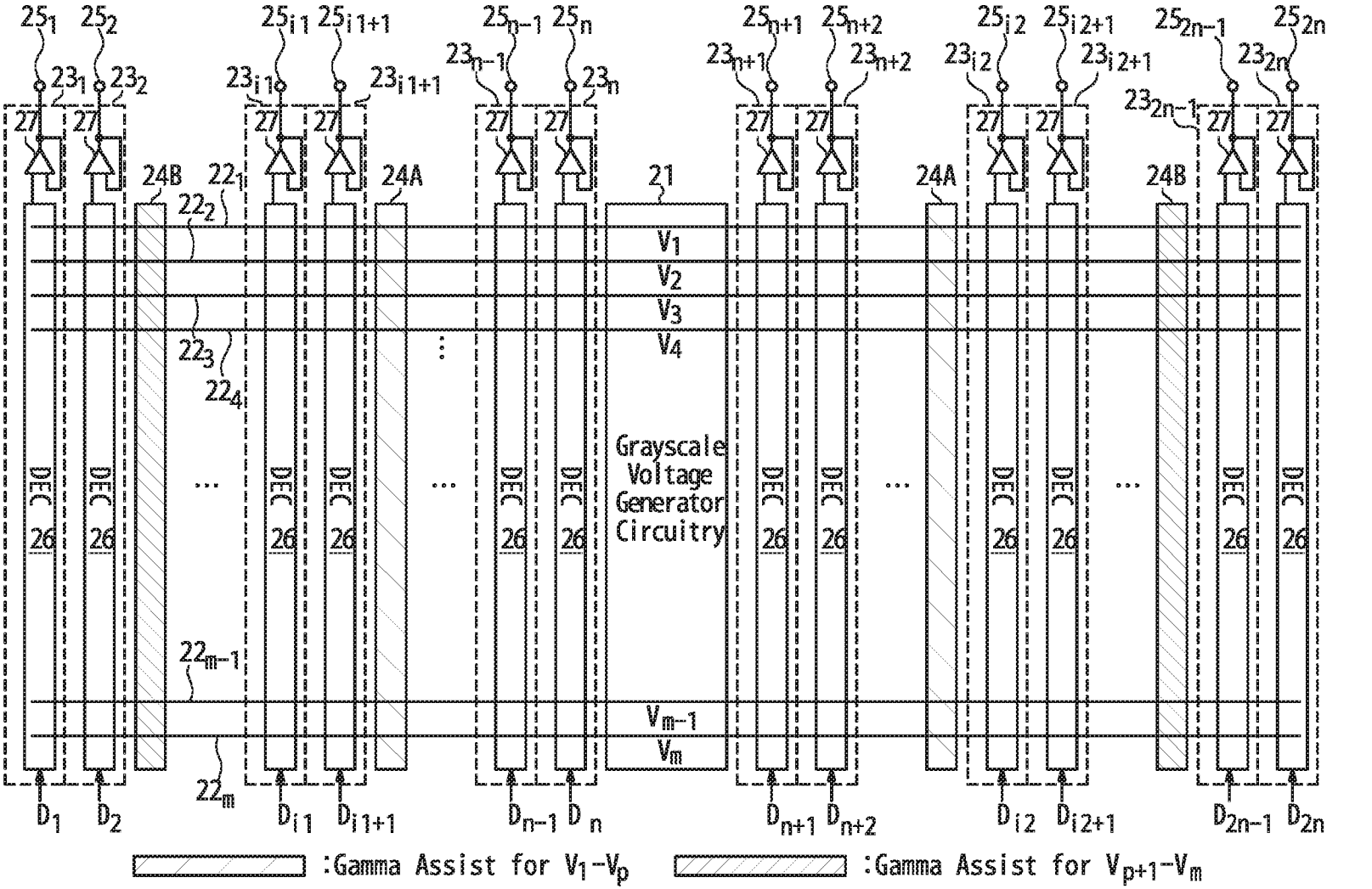
FIG. 6 illustrates one example configuration of source driver circuitry, according to one or more embodiments.

In one or more embodiments, as illustrated in FIG. 6, gamma assist circuitries 24A and 24B are disposed, where the gamma assist circuitries 24A offer the gamma assist operation for ones of grayscale lines $\mathbf{22}_1$ to $\mathbf{22}_m$ belonging to a first group, and the gamma assist circuitries 24B offer the gamma assist operation for different ones of grayscale lines $\mathbf{22}_1$ to $\mathbf{22}_m$, the different ones belonging to a second group instead of the first group. In one or more embodiments, the gamma assist circuitries 24A are not connected to the grayscale lines 22 belonging to the second group; the gamma assist circuitries 24A do not offer the gamma assist operation for the grayscale lines 22 belonging to the second group. In one or more embodiments, the gamma assist circuitries 24B are not connected to the grayscale lines 22 belonging to the first group; the gamma assist circuitries 24B do not offer the gamma assist operation for the grayscale lines 22 belonging to the first group.

In one or more embodiments, the gamma assist circuitries 24A offer the gamma assist operation for the grayscale lines $\mathbf{22}_1$ to $\mathbf{22}_p$ and the gamma assist circuitries 24B offer the gamma assist operation for the grayscale lines $\mathbf{22}_{p+1}$ to $\mathbf{22}_m$, where p is a given number larger than one and smaller than m. In one or more embodiments, p may be m/2 when m is divisible by two. In one or more embodiments, the gamma assist circuitries 24A and the gamma assist circuitries 24B are located at different positions along the direction in which the grayscale lines $\mathbf{22}_1$ to $\mathbf{22}_m$ are extended. This arrangement is useful for a case when a single gamma assist circuitry cannot incorporate gamma assist unit circuits 28 connected to all the grayscale lines $\mathbf{22}_1$ to $\mathbf{22}_m$ due to a restriction in the area of each gamma assist circuitry. In one or more embodiments, the gamma assist circuitries 24A each comprise gamma assist unit circuits $\mathbf{28}_1$ to $\mathbf{28}_p$ connected to the grayscale lines $\mathbf{22}_1$ to $\mathbf{22}_p$, respectively, while not connected to the grayscale lines $\mathbf{22}_{p+1}$ to $\mathbf{22}_m$. In one or more embodiments, the gamma assist circuitries 24B each comprise gamma assist unit circuits $\mathbf{28}_{p+1}$ to $\mathbf{28}_m$ connected to the grayscale lines $\mathbf{22}_{p+1}$ to $\mathbf{22}_m$, respectively, while not connected to the grayscale lines $\mathbf{22}_1$ to $\mathbf{22}_p$.

Figure 7:
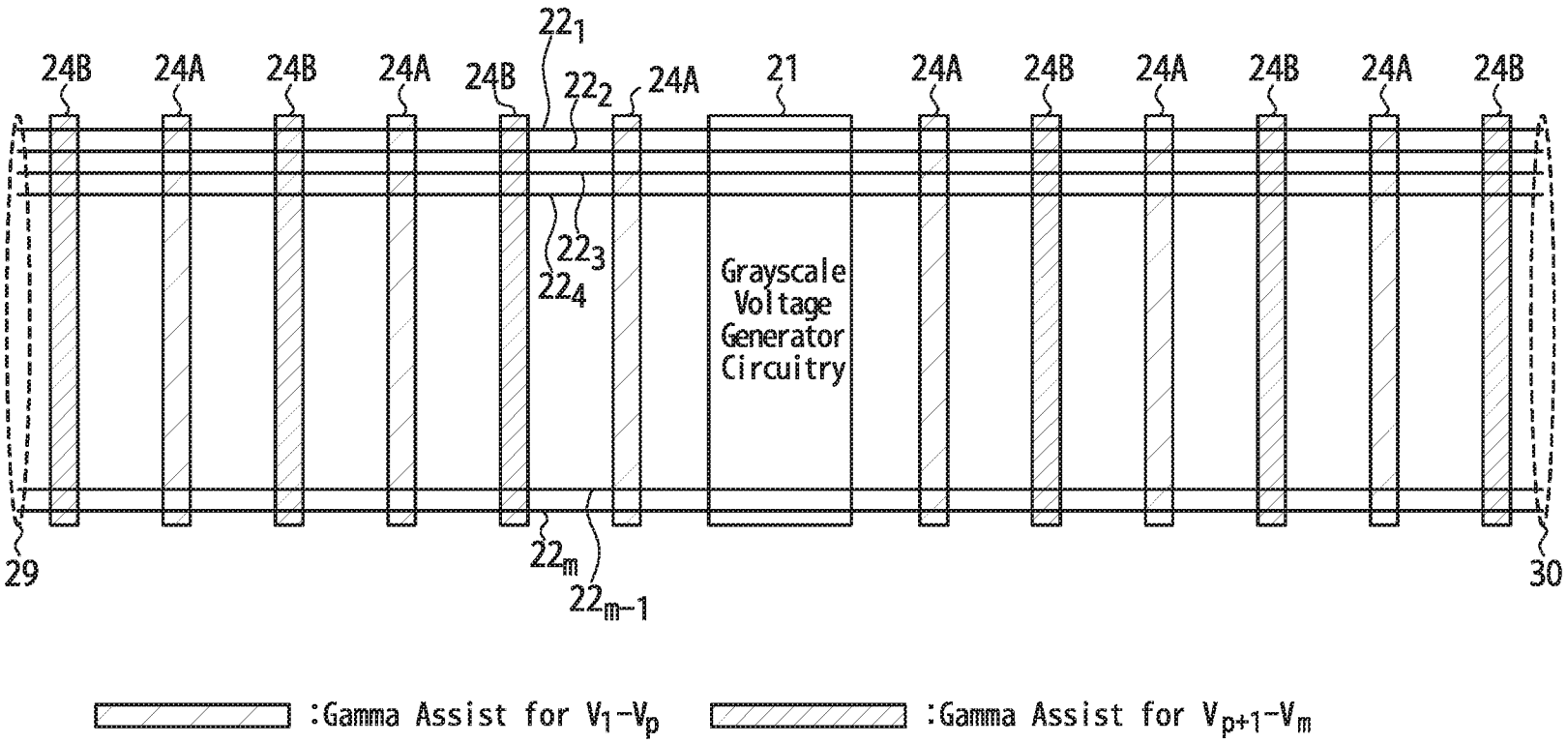
FIG. 7 illustrates one example arrangement of gamma assist circuitry, according to one or more embodiments.

In one or more embodiments, as illustrated in FIG. 7, the gamma assist circuitries 24A and the gamma assist circuitries 24B are alternately arranged. In one or more embodiments, one of the gamma assist circuitries 24A and 24B is disposed at the first ends 29 of the grayscale lines $\mathbf{22}_1$ to $\mathbf{22}_m$, and another of the gamma assist circuitries 24A and 24B is disposed at the second ends 30 of the grayscale lines $\mathbf{22}_1$ to $\mathbf{22}_m$. Illustrated in FIG. 7 is the configuration in which one of the gamma assist circuitries 24B is disposed at the first ends 29 of the grayscale lines $\mathbf{22}_1$ to $\mathbf{22}_m$, and another of the gamma assist circuitries 24B is disposed at the second ends 30 of the grayscale lines $\mathbf{22}_1$ to $\mathbf{22}_m$. In one or more embodiments, half the remaining gamma assist circuitries 24A and 24B are disposed between the grayscale voltage generator circuitry 21 and the gamma assist circuitry 24A or 24B disposed at the first ends 29 at constant intervals, and the remaining half are disposed between the grayscale voltage generator circuitry 21 and the gamma assist circuitry 24A or 24B disposed at the second ends 30 at constant intervals.

Figure 8:
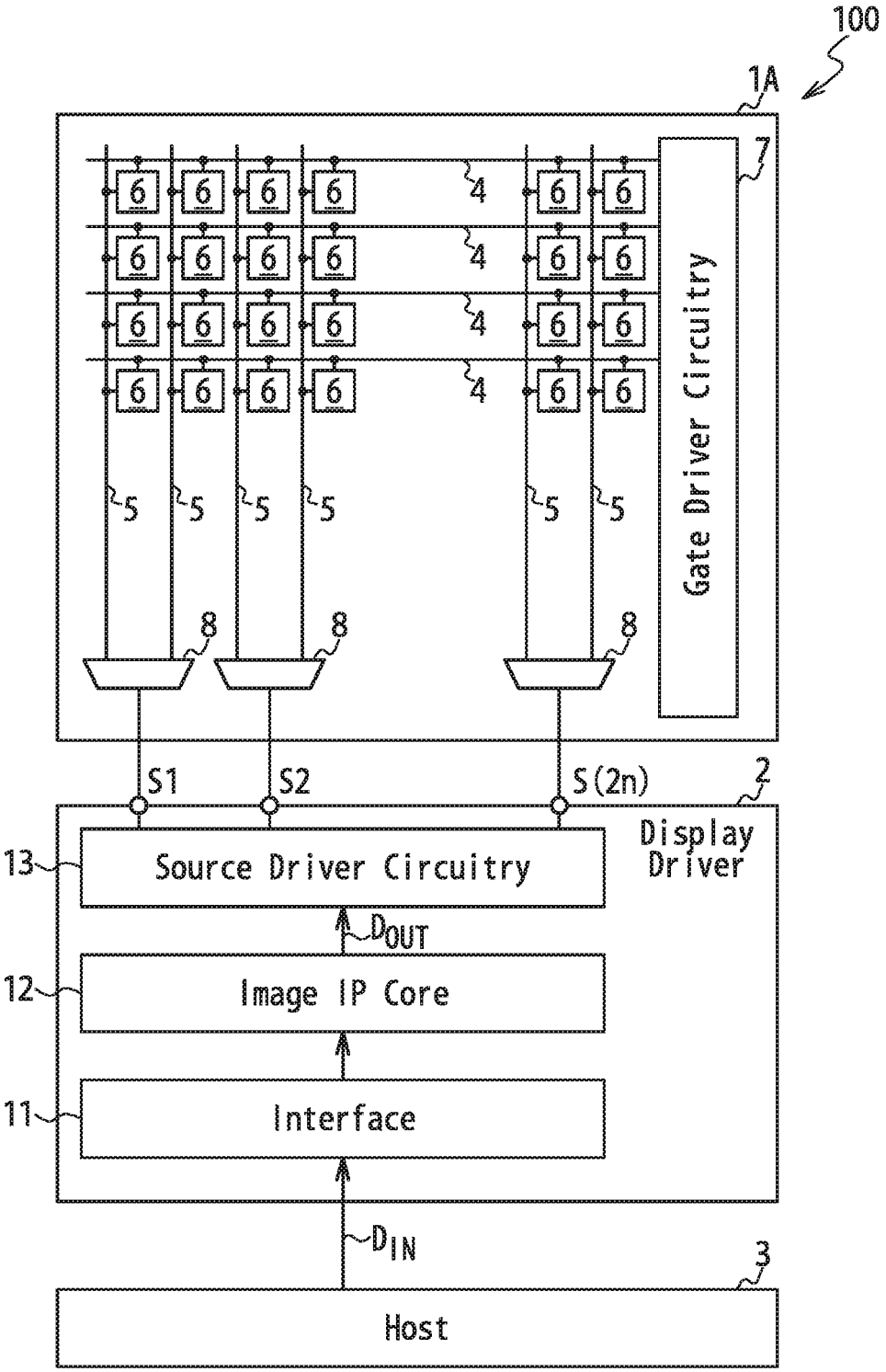
FIG. 8 illustrates one example configuration of a display device, according to one or more embodiments.

In one or more embodiments, as illustrated in FIG. 8, multiplexers 8 selecting source lines 5 are disposed in a display panel 1A to achieve time division driving. In one or more embodiments, source lines 5 selected by the multiplexers 8 are connected to the source outputs S1 to S(2*n*), and source output voltages are written into desired display elements 6 via the selected source lines 5. In one or more embodiments, two source lines 5 are connected to each multiplexer 8, and each multiplexer 8 connects the source line 5 selected from the two source lines 5 connected thereto to the corresponding source output Si. In one or more embodiments, three or more source lines 5 may be connected to each multiplexer 8. In such embodiments, each multiplexer 8 connects the source line 5 selected from the three or more source lines 5 connected thereto to the corresponding source output Si.

Figure 9:
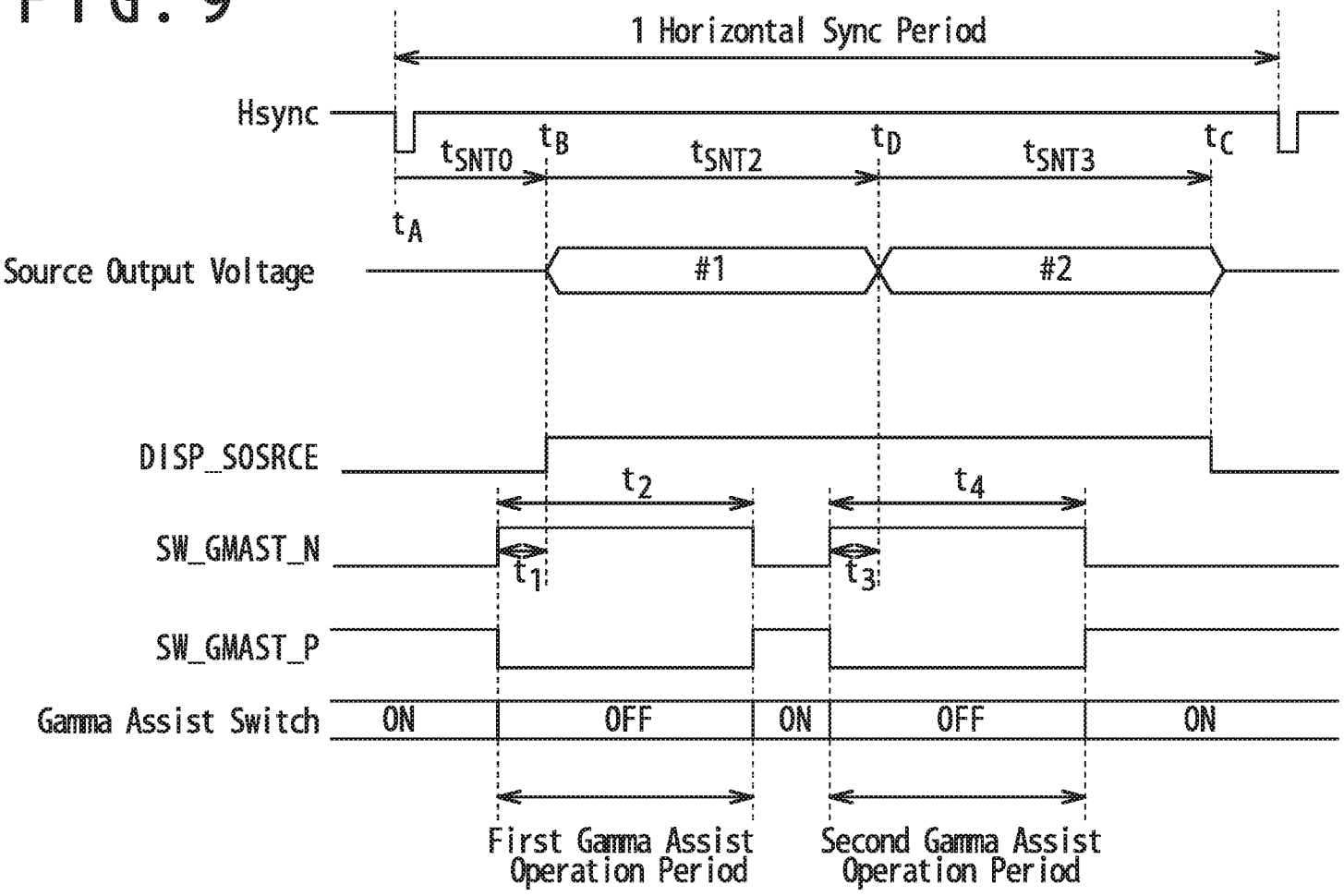
FIG. 9 illustrates one example operation of gamma assist circuitry, according to one or more embodiments.

When two source lines 5 are connected to each multiplexer 8, in one or more embodiments, the source output voltage is switched in synchronization with the selection of the two source lines 5 as illustrated in FIG. 9. In FIG. 9, the legend "#1" represents a source output voltage corresponding to the source line 5 first selected in each horizontal sync period, and the legend "#2" represents a source output voltage corresponding to the source line 5 subsequently selected in each horizontal sync period.

In one or more embodiments, the source amplifier control signal DISP_SOSRCE is asserted at time $t_B$ when a period of time $t_{SNT0}$ has elapsed after each horizontal sync period starts at time $t_A$. In one or more embodiments, the source amplifiers 27 start to output the source output voltages #1 based on the pixel data $D_1$ to $D_{2n}$ at time $t_B$. In one or more embodiments, at time $t_D$ when a time duration $t_{SNT2}$ has elapsed thereafter, the source output voltage outputted from the source amplifiers 27 are switched from the source output voltages #1 to the source output voltages #2. In such embodiments, the source output voltages start to change at time to as well as time $t_B$. In one or more embodiments, the switching of the source output voltages is achieved by switching the pixel data $D_1$ to $D_{2n}$ supplied to the decoders 26.

In one or more embodiments, the gamma assist operation is performed in a first gamma assist operation period defined to include time $t_B$ and a second gamma assist operation period defined to include time $t_D$.

The switch control signals SW_GMAST_P and SW_GMAST_N are asserted to turn on the gamma assist switch 31, until the first gamma assist operation period starts after each horizontal sync period starts. This achieves writing the grayscale voltage $V_i$ on the grayscale line $\mathbf{22}_i$ into the holding node $N_{HLD}$ of the gamma assist unit circuit $\mathbf{28}_i$.

In one or more embodiments, the first gamma assist operation period is starts a time duration $t_1$ in advance before the time $t_B$, which is the time when the source output voltages start to change. In one or more embodiments, the gamma assist switch 31 is turned off when the gamma assist operation period has started. In one or more embodiments, the gamma assist operation is performed to drive the grayscale line $22_i$ based on the voltage between the holding node $N_{HLD}$ and the output node $N_{OUT}$ when the gamma assist switch 31 is turned off.

In one or more embodiments, the first gamma assist operation period continues for a time duration $t_2$. In one or more embodiments, the time duration $t_2$ is set to be sufficiently long for completing the changes in the source output voltages in the first gamma assist operation period. In one or more embodiments, the gamma assist switch 31 is turned on to stop the gamma assist operation when the first gamma assist operation period has elapsed.

In one or more embodiments, the second gamma assist operation period starts a time duration $t_3$ in advance before the time to, which is the time when the source output voltages start to change. In one or more embodiments, the gamma assist switch 31 is turned off when the second gamma assist operation period has started. In one or more embodiments, the gamma assist operation is performed to drive the grayscale line $22_i$ based on the voltage between the holding node $N_{HLD}$ and the output node $N_{OUT}$ when the gamma assist switch 31 is turned off.

In one or more embodiments, the second gamma assist operation period continues for a time duration $t_4$. In one or more embodiments, the time duration $t_4$ is set to be sufficiently long for completing the changes in the source output voltages in the second gamma assist operation period. In one or more embodiments, the gamma assist switch 31 is turned on to stop the gamma assist operation when the second gamma assist operation period has elapsed.

In one or more embodiments, the source amplifier control signal DISP_SOSRCE is then negated at time $t_C$ when a period of time $t_{SNT3}$ has elapsed after time $t_D$, and the source amplifiers 27 stop outputting the source output voltages based on the pixel data $D_1$ to $D_{2n}$ at time $t_C$ In one or more embodiments, the source output voltages are similarly switched in synchronization with selection of the source lines 5 after the source output voltages start to be outputted when three or more source lines 5 are connected to each multiplexer 8. In one or more embodiments, gamma assist operation periods are defined to each include the time when the source output voltages start to be outputted and the times when the source output voltages are switched, and the gamma assist operation is performed during the gamma assist operation periods.

Although various embodiments of this disclosure have been specifically described, the technologies described in this disclosure may be implemented with various modifications.

What is claimed is:

1. A display driver, comprising:

a first grayscale line extending in a direction, the first grayscale line configured to distribute a first grayscale voltage provided by a grayscale voltage generator circuitry;

output circuitry configured to receive the first grayscale voltage on the first grayscale line and perform digital-analog conversion on a pixel data to output a source output voltage corresponding to the pixel data, the digital-analog conversion being based on the first grayscale voltage; and first gamma assist circuitry different from the grayscale voltage generator circuitry and disposed at a first position along the direction, apart from the grayscale voltage generator circuitry, the first gamma assist circuitry comprising:

a first holding node configured to store a first reference grayscale voltage received on the first grayscale line; and a source follower circuitry configured to drive the first grayscale line based on a difference between the first reference grayscale voltage in the first holding node and the first grayscale voltage, wherein the source follower circuitry comprises four MOS transistors and two constant current sources.

2. The display driver according to claim 1, wherein:

a first of the four MOS transistors has a source directly connected to the first grayscale line and is configured to generate, based on a first potential on the first holding node, a second potential on a drain thereof through a source follower operation; and a second of the four MOS transistors is directly connected between the first grayscale line and a potential-fixed line of a fixed potential and is configured to drive the first grayscale line based on the potential of the drain of the first of the four MOS transistors.

3. The display driver according to claim 2, wherein the first gamma assist circuitry further comprises a first capacitor element connected between the first holding node and the potential-fixed line.

4. The display driver according to claim 1, wherein:

a first NMOS transistor of the four MOS transistors has a source directly connected to the first grayscale line and is configured to generate, based on a first potential on the first holding node, a second potential on a drain thereof through a source follower operation; and a first PMOS transistor of the four MOS transistors is directly connected between the first grayscale line and a power supply line and is configured to drive the first grayscale line based on the potential of the drain of the first NMOS transistor.

5. The display driver according to claim 4, wherein:

a second PMOS transistor of the four MOS transistors has a source connected to the first grayscale line and is configured to generate, based on the first potential on the first holding node, a third potential on a drain thereof through a source follower operation; and a second NMOS transistor of the four MOS transistors is connected between the first grayscale line and a grounding line and is configured to drive the first grayscale line based on the potential of the drain of the second PMOS transistor.

6. The display driver according to claim 5, wherein:

a first constant current source of the two constant current sources is configured to supply a first constant current to the drain of the first NMOS transistor; and a second constant current source of the two constant current sources is configured to draw a second constant current from the drain of the second PMOS transistor.

7. The display driver according to claim 4, wherein the first gamma assist circuitry further comprises a first capacitor element connected between the first holding node and the power supply line.

8. The display driver according to claim 5, wherein the first gamma assist circuitry further comprises a second capacitor element connected between the first holding node and the grounding line.

9. The display driver according to claim 1, wherein the first gamma assist circuitry further comprises a switch connected between the first grayscale line and the first holding node.

10. The display driver according to claim 9, wherein the switch is configured to be turned on during a first period of a horizontal sync period and turned off during a second period following the first period in the horizontal sync period, the second period including a time when the output circuitry starts outputting the source output voltage.

11. The display driver according to claim 10, wherein the switch is configured to be turned on during a third period following the second period in the horizontal sync period.

12. The display driver according to claim 1, further comprising:

a second grayscale line extended in the direction; and second gamma assist circuitry comprising a second holding node configured to store a reference value of a second grayscale voltage received on the second grayscale line and to drive the second grayscale line based on a difference between the reference value in the second holding node and the second grayscale voltage, the second gamma assist circuitry being not connected to the first grayscale line, wherein the second gamma assist circuitry is disposed at a second position, different from the first position, along the direction.

13. The display driver according to claim 12, wherein the output circuitry is configured to receive the second grayscale voltage from the second grayscale line and perform the digital-analog conversion based on the first grayscale voltage and the second grayscale voltage.

14. A display device, comprising:

a display panel; and a display driver, wherein the display driver comprises:

a grayscale line extending in a direction, the grayscale line configured to distribute a grayscale voltage provided by a grayscale voltage generator circuitry;

output circuitry configured to receive the grayscale voltage on the grayscale line and perform digital-analog conversion on a pixel data to output a source output voltage corresponding to the pixel data, the digital-analog conversion being based on the grayscale voltage; and gamma assist circuitry different from the grayscale voltage generator circuitry and disposed at a position along the direction, apart from the grayscale voltage generator circuitry, the gamma assist circuitry comprising:

a holding node configured to store a reference grayscale voltage received on the grayscale line; and a source follower circuitry configured to drive the grayscale line based on a difference between the reference grayscale voltage in the holding node and the grayscale voltage, wherein the source follower circuitry comprises four MOS transistors and two constant current sources.

15. The display device according to claim 14, wherein:

a first of the four MOS transistors has a source directly connected to the grayscale line and is configured to generate, based on a first potential on the holding node, a second potential on a drain thereof through a source follower operation; and a second of the four MOS transistors is directly connected between the grayscale line and a potential-fixed line of a fixed potential and is configured to drive the grayscale line based on the potential of the drain of the first MOS transistor.

16. The display device according to claim 15, wherein the gamma assist circuitry further comprises a first capacitor element connected between the holding node and the potential-fixed line.

17. The display device according to claim 14, wherein the gamma assist circuitry further comprises a switch connected between the grayscale line and the holding node.

18. A method, comprising:

receiving, by a gamma assist circuitry, a grayscale voltage from a grayscale voltage generator circuitry on a grayscale line, the grayscale line extending in a direction and configured to distribute the grayscale voltage provided by the grayscale voltage generator circuitry;

performing digital-analog conversion on a pixel data to output a source output voltage corresponding to the pixel data, the digital-analog conversion being based on the gray scale voltage;

storing, in a holding node of the gamma assist circuitry, a reference grayscale voltage received on the grayscale line; and driving by a source follower circuitry, the grayscale line based on a difference between the reference grayscale voltage in the holding node and the grayscale voltage, wherein the source follower circuitry comprises four MOS transistors and two constant current sources wherein the gamma assist circuitry is different from the grayscale voltage generator circuitry, and wherein the gamma assist circuitry is disposed at a position along the direction, apart from the grayscale voltage generator circuitry.

19. The method according to claim 18, wherein storing the reference grayscale voltage on the holding node comprises:

electrically connecting the grayscale line and the holding node during a first period of a horizontal sync period; and electrically disconnecting the grayscale line and the holding node during a second period following the first period in the horizontal sync period, the second period including a time when the source output voltage starts to be outputted.

20. The method according to claim 19, wherein storing the reference grayscale voltage on the holding node further comprises:

electrically connecting the grayscale line and the holding node during a third period following the second period in the horizontal sync period.

* * * * *